US008091264B2

(12) United States Patent
Goertz

(10) Patent No.: US 8,091,264 B2
(45) Date of Patent: Jan. 10, 2012

(54) FIREARM WITH UNDERARM GUN STOCK

(76) Inventor: Samuel Dean Goertz, Houston, TX (US)

( * ) Notice: Subject to any disclaimer, the term of this patent is extended or adjusted under 35 U.S.C. 154(b) by 402 days.

(21) Appl. No.: 12/490,275

(22) Filed: Jun. 23, 2009

(65) Prior Publication Data

US 2009/0313872 A1 Dec. 24, 2009

Related U.S. Application Data

(60) Provisional application No. 61/132,873, filed on Jun. 23, 2008.

(51) Int. Cl.
*F41C 9/00* (2006.01)

(52) U.S. Cl. ..... 42/1.11; 42/69.01; 42/71.01

(58) Field of Classification Search ..... 42/1.11, 42/69.01, 71.01
See application file for complete search history.

(56) References Cited

U.S. PATENT DOCUMENTS

| | | | | |
|---|---|---|---|---|
| 1,027,556 | A | | 5/1912 | Marshall |
| 1,111,905 | A | | 9/1914 | Keeran |
| 1,340,127 | A | | 5/1920 | Welch |
| 1,726,228 | A | * | 8/1929 | Juhasz ..... 42/1.11 |
| 1,885,180 | A | * | 11/1932 | Cameron ..... 222/175 |
| 2,436,175 | A | | 2/1948 | Neal |
| 2,977,703 | A | | 4/1961 | Sarvis |
| 3,162,966 | A | | 12/1964 | La Coss |
| 3,184,877 | A | | 5/1965 | Andrews |
| 3,209,481 | A | | 10/1965 | Gilbert |
| 3,648,396 | A | | 3/1972 | Smith |
| 4,291,482 | A | | 9/1981 | Bresan |
| 4,398,365 | A | * | 8/1983 | Pokhis ..... 42/1.11 |
| 4,601,123 | A | | 7/1986 | Swearengen et al. |
| 5,018,294 | A | | 5/1991 | McGuffee |
| 5,180,874 | A | | 1/1993 | Troncoso, Jr. |
| 5,852,253 | A | * | 12/1998 | Baricos et al. ..... 89/1.41 |
| 6,016,620 | A | | 1/2000 | Morgan |
| 7,290,366 | B2 | * | 11/2007 | Endres ..... 42/1.11 |
| 2005/0039368 | A1 | | 2/2005 | Crawford |

* cited by examiner

*Primary Examiner* — Troy Chambers
(74) *Attorney, Agent, or Firm* — Carrie A. Boone, P.C.

(57) ABSTRACT

A novel firearm includes an underarm gun stock. The stock of the firearm is to be positioned under the forearm of the firearm user. Alternatively, the firearm has no underarm stock, but the action and barrel of the firearm are disposed beneath the forearm or the wrist of the user. The novel firearms promote a more steady shot with a single hand, the ability to support heavier firepower in a more compact package, and other advantages not found in prior art handguns or rifles.

20 Claims, 11 Drawing Sheets

FIREARM WITH UNDERARM GUN STOCK

PRIORITY CLAIM

This application claims priority to U.S. provisional patent application No. 61/132,873, filed on Jun. 23, 2008.

TECHNICAL FIELD

This application relates to firearms and, more particularly, to a specialized firearm having an underarm gun stock.

BACKGROUND

Historically, handheld firearms (pistol, shotgun, or rifle) are designed to be sighted along the top of the barrel(s). For this reason, the hand grip(s), pistol grip(s), stock, and/or forearm are mounted below the barrel(s) to allow an unobstructed sighting along the top of the barrel(s).

FIG. 1 is a diagram of a handgun 30 according to the prior art. The handgun 30 includes an action 10, the action being the receiver of the gun containing a firing mechanism. Thus, the action 10 includes a hammer 26, a cylinder 18, and a trigger 20. The cylinder 18 includes storage for the ammunition, and rotates as the hammer 26 is cocked. A person using the handgun 30 holds the gun by the handle/grip 24, with the index finger tripped around the trigger 20. Once the trigger 20 is pulled, a bullet stored in the cylinder is fired through the barrel 12, out the muzzle 16 toward a target.

As FIG. 1 shows, a front sight 14 and a rear sight 13 are located at the top of the barrel 12, with the action 10 and trigger 20 disposed adjacent to or below the barrel. Before firing the handgun 30, the person generally has feet planted, with the arm holding the gun extended somewhat from the body, usually at shoulder level. A strong stance is generally necessary, as the gun may "kick back" somewhat upon firing. The front and rear sights 13, 14 enable the handgun user to visually align the barrel with the target.

FIG. 2 is a diagram of a prior art rifle 60. Like the handgun 30, the rifle 60 has an action 40. In this case, the action 40 includes the trigger 50, the chamber 58, and the magazine 53, where the magazine holds the ammunition. The rifle 60 also features a front sight 44, a rear sight 43, a barrel 42, and a muzzle 46. Unlike the handgun 30, the rifle 60 also includes a stock 54, a butt 48 and, in this embodiment, a forestock 56. The stock 54 and butt 48 are meant to be positioned against the shoulder, with the user gripping the forestock, if present, enabling the rifle user to visually align the front 44 and rear 43 sights with the target. The stock 54 is generally made of wood or some composite material.

Some modern handheld firearms have deviated somewhat from the historical design. In some cases, parts of the action are placed above the barrel(s), extending the sights to reach above the action. Other firearms have moved the magazine above the barrel(s) as well, but have also extended the sights.

Legacy handheld firearms, rifles, and shotguns in particular are designed to be held up with both hands and against the shoulder, then sighted along the barrel(s). Even a pistol, although designed to be fired with a single hand, is held up and extended away from the body. The extension of the weight of the weapon beyond the body of the shooter makes for an awkward position/posture to support the weight of the firearm, especially for larger and more powerful guns, and may require additional bracing to steady the firearm for shooting accuracy.

BRIEF DESCRIPTION OF THE DRAWINGS

The foregoing aspects and many of the attendant advantages of this document will become more readily appreciated as the same becomes better understood by reference to the following detailed description, when taken in conjunction with the accompanying drawings, wherein like reference numerals refer to like parts throughout the various views, unless otherwise specified.

DETAILED DESCRIPTION

In accordance with the embodiments described herein, a novel firearm is disclosed, which includes an underarm gun stock. Unlike prior art rifles, the stock of the novel firearm is to be positioned beneath the forearm of the firearm user. The action of the firearm is disposed below the stock. The novel firearm promotes a more steady shot with a single hand, the ability to support heavier firepower in a more compact package, and other advantages not found in prior art handguns or rifles.

In the following detailed description, reference is made to the accompanying drawings, which show by way of illustration specific embodiments in which the invention may be practiced. However, it is to be understood that other embodiments will become apparent to those of ordinary skill in the art upon reading this disclosure. The following detailed description is, therefore, not to be construed in a limiting sense, as the scope of the present invention is defined by the claims.

Figure 3:
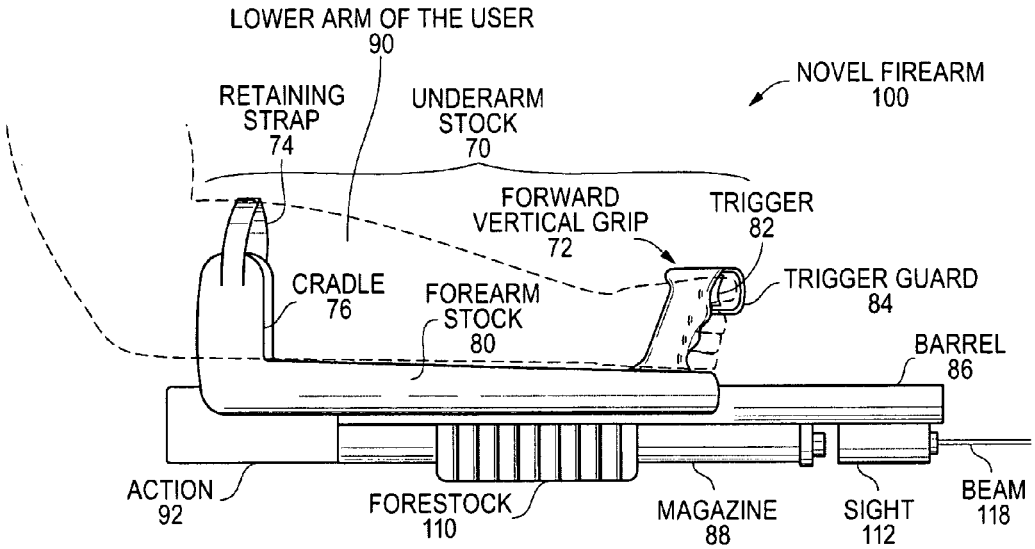
FIG. 3 is a diagram of a novel firearm including an underarm stock, according to some embodiments.

FIG. 3 is a diagram of a novel firearm 100 including an underarm stock 70, according to some embodiments. The novel firearm 100 has many of the features found in a typical rifle or handgun, some of which are relocated in a manner unfamiliar to gun owners. It will become apparent to one having knowledge about guns, however, that the various features are arranged to promote holding the firearm easily, comfort during use of the firearm, and other advantages.

The underarm stock 70 is designed to attach the firearm 100 beneath the forearm of a user 90. (The user 90 may be a male or a female, but, for simplicity, will be referred to herein as a male.) In some embodiments, the underarm stock 70 is made up of a forearm stock 80, with a cradle 76 at one end and a forward vertical grip 72 at the other end. In FIG. 3, the cradle 76 is also coupled to a retaining strap 74. In a preferred embodiment, the forearm stock 80 and the cradle 76 are made from a natural material, such as walnut or other wood, bone, horn, or ivory. In other embodiments, the forearm stock 80 and cradle 76 is made using thermoplastics or composite materials, such as carbon fiber composites, Kevlar, or fiberglass.

The forearm stock 80 and cradle 76 are thus rigid against the forearm of the user. In contrast, the retaining strap 74 may be made with a strong fabric material that is attached to one end of the cradle 76 by any of several known means.

Figure 4:
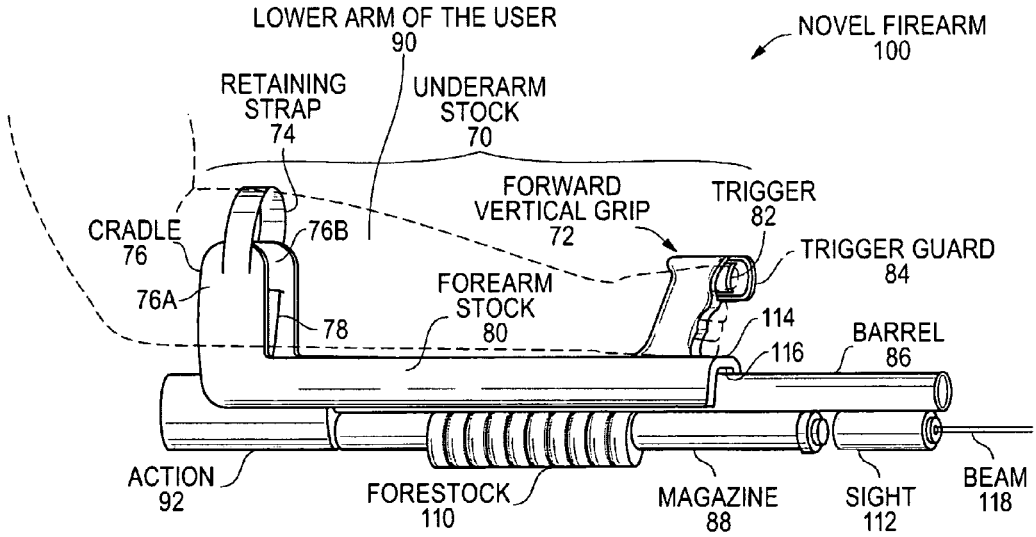
FIG. 4 is a perspective diagram of the novel firearm of FIG. 3, according to some embodiments.

FIG. 4 is a perspective view of the novel firearm 100 of FIG. 3, according to some embodiments. In a preferred embodiment, the retaining strap 74 is permanently connected to a lateral portion 76A of the cradle 76 while being affixed to and removed from a medial portion 76B of the cradle. The user inserts his forearm into the underarm stock 70 by feeding his hand through the cradle 76 and clutching the forward vertical grip 72. The retaining strap 74 is next wrapped over the forearm, starting at the outside of the arm, and attaches to the cradle 76 at the inside of the arm. For ease of connection, the retaining strap 74 may be made of Velcro, with the "hook" ("loop") portion being affixed to the medial portion 76B of the cradle, and the "loop" ("hook") portion being part of the retaining strap. In another implementation, the "hook" and "loop" Velcro portions are both part of the retaining strap 76, and the medial portion 76B of the cradle has a loop 78 affixed thereto. The Velcro retaining strap is thus threaded through the loop 78 and secured to itself. Alternatively, buttons, snaps, zippers, and other means may be used for securing the retaining strap 76 flush against the forearm of the user 90 (not shown).

Figure 1:
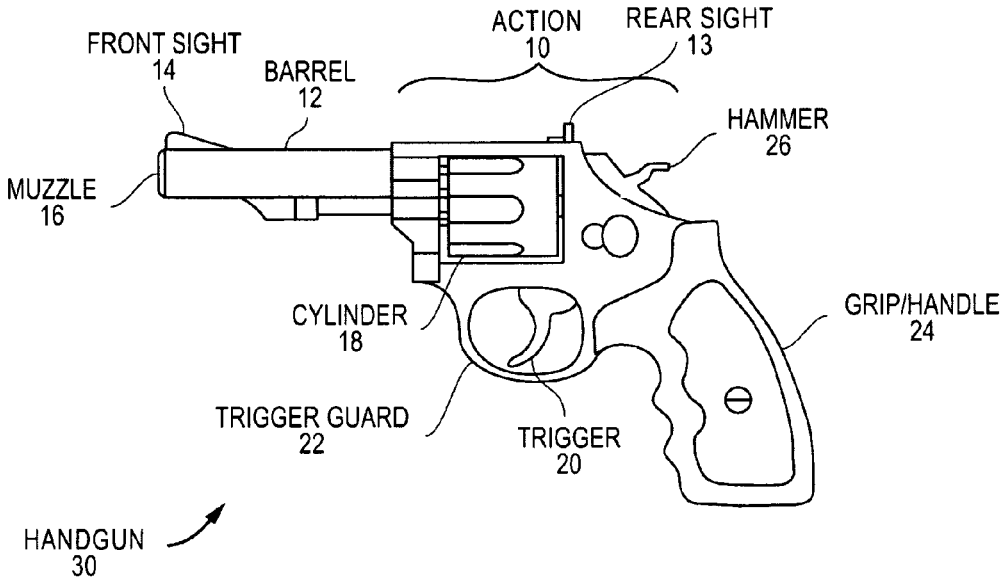
FIGURE 1 (Prior Art)
FIG. 1 is a diagram of a handgun, according to the prior art.

In contrast to known firearms, the stock of the novel firearm 100 is disposed below the lower arm (or forearm) of the user 90. The stock 70 incorporates a forward vertical grip, hand grip, or pistol grip 72, at or near the forward end of the stock and/or firearm. The stock 80 and hand grip 72 may be two or more pieces and may be part of the action 92 or barrel 86. As another possibility, the cradle 76 and hand grip 72 may be mounted to rails, which are disposed on the action and/or barrel. (This embodiment is described in FIGS. 6A and 6B, below.) In some embodiments, the forward vertical grip 72 is made using a rigid material, and may be made of the same material as the forearm stock 80 and the cradle 76. In other embodiments, the forward vertical grip 72 is made of materials similar to those of the grip/handle 24 of the handgun 30 in FIG. 1.

The forward vertical grip 72 includes a trigger 82 and a trigger guard 84. The trigger guard 84 guides the trigger finger (typically, the index finger of the user 90) to be placed through the trigger guard when the user wears the underarm stock 70. The vertical grip 72, the trigger 82, and the trigger guard 84 are the only legacy (traditional) firearm features that are disposed above the underarm stock 70. As described below, all other legacy firearm features of the novel firearm 100 are disposed below the underarm stock 70.

Figure 5A:
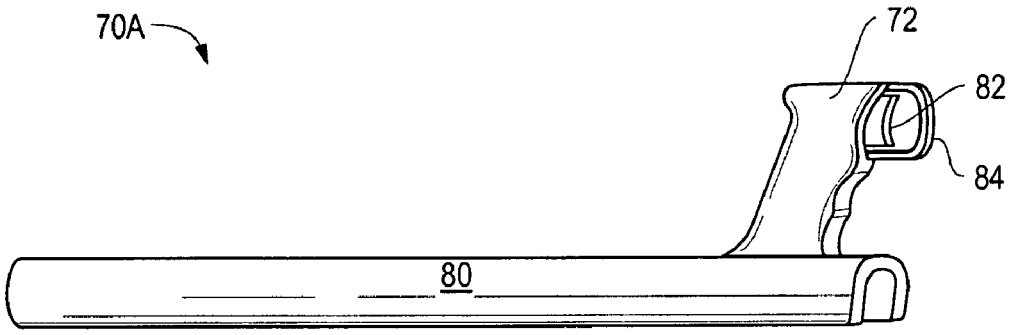
FIGS. 5A-5H are diagram of several different underarm stocks, according to some embodiments.
Figure 5B:
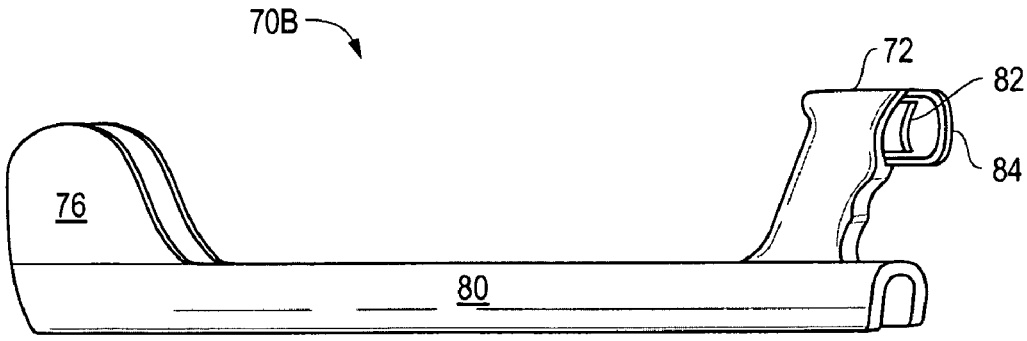
Figure 5C:
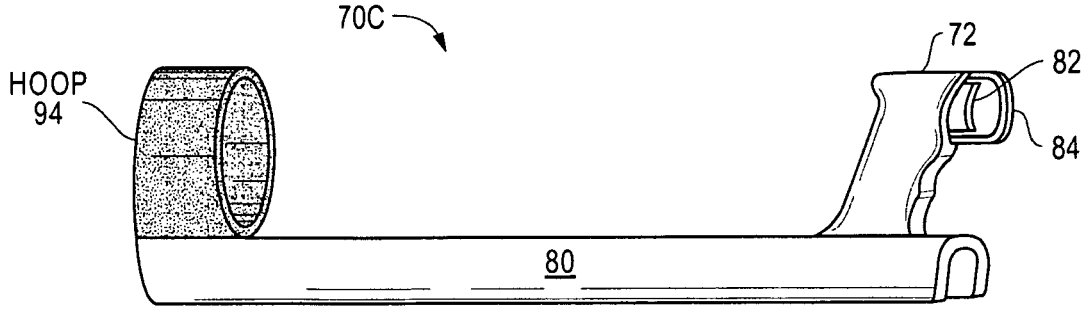
Figure 5D:
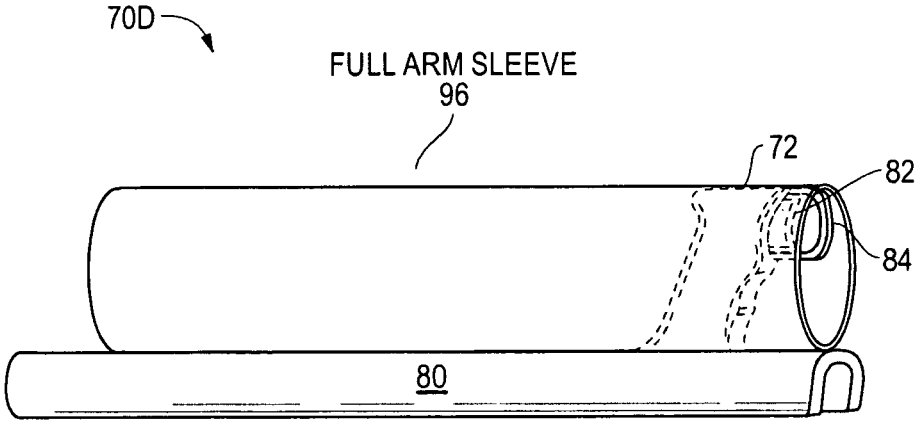
Figure 5E:
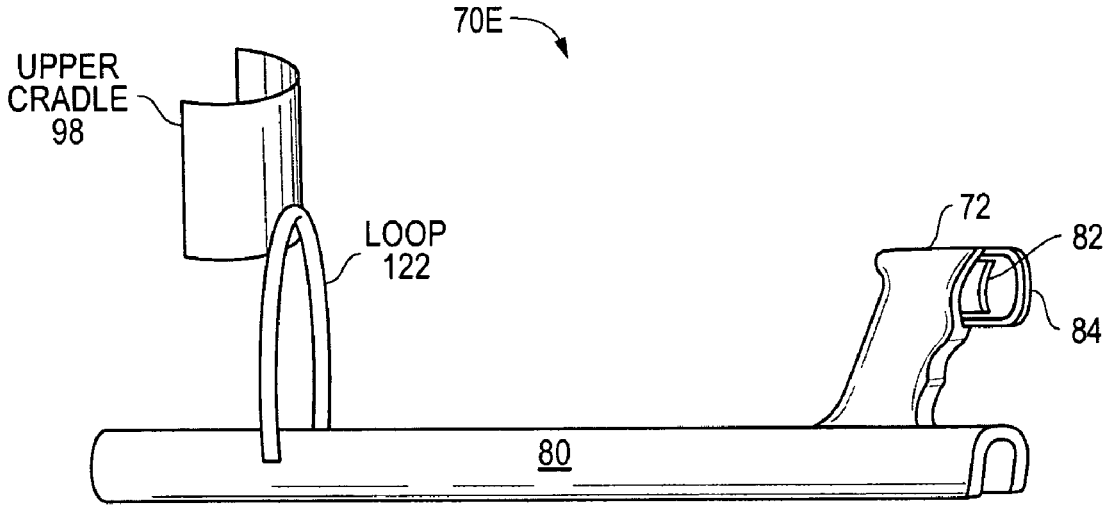
Figure 5F:
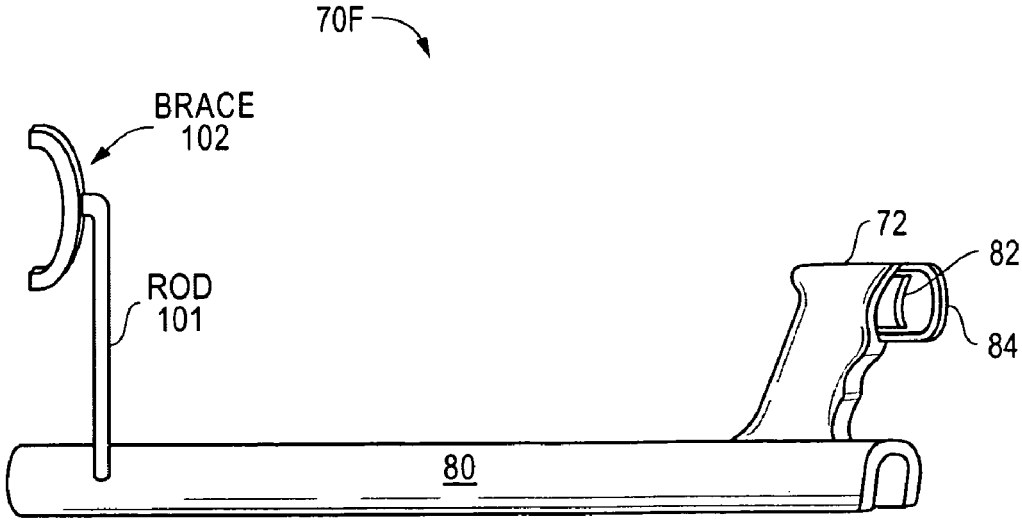
Figure 5G:
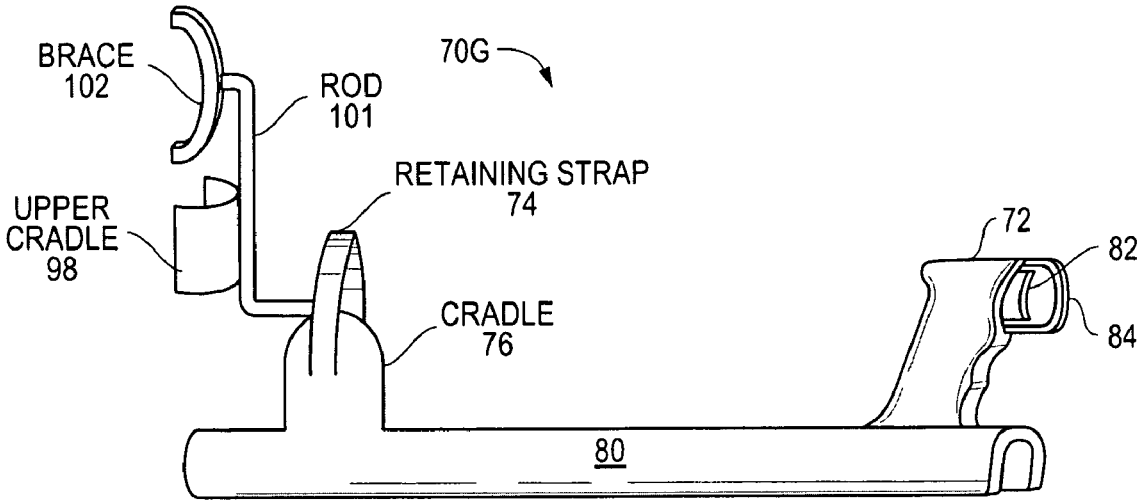
Figure 5H:
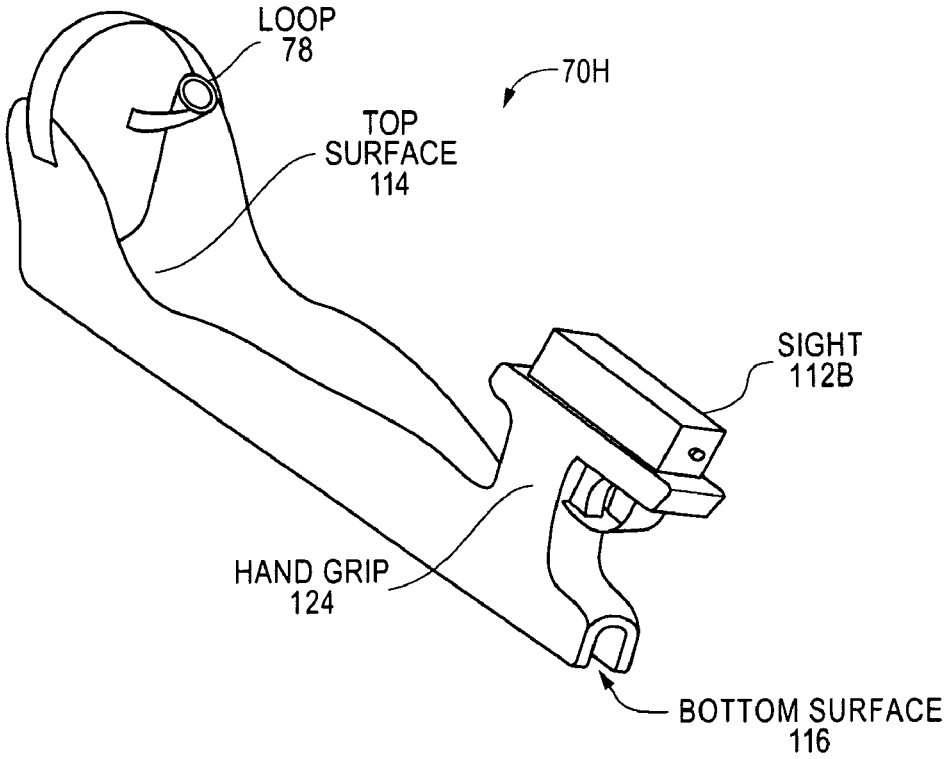

In the perspective view of the underarm stock 70 (FIG. 4), a top surface 114 of the forearm stock 80 is shaped to fit the forearm of the user 90 (see also FIG. 5H). The forearm stock 80 may be custom-crafted to fit a particular forearm, such as by creating a mold of the user's forearm. The custom-crafted underarm stock 70 is likely to fit the forearm of the user very well. As another alternative, the underarm stock 70 may be available for sale in a variety of sizes, with the retaining strap 74 providing the adjustment means to ensure a snug fit.

In some embodiments, the novel firearm 100 features a barrel 86, a magazine 88, and an action 92. As also illustrated in the underarm stock 70H (FIG. 5H), a bottom surface 116 of the forearm stock 80 is fluted to receive the barrel 86, in some embodiments, such that the barrel is flush against the forearm stock. The barrel 86 extends somewhat in front of the hand grip 72. In some embodiments, the barrel 86 extends three to six inches in front of the hand grip. The length of the barrel 86 depends on achieving a desired balance with the action 92 and the magazine 88. The magazine 88 and the action 92 are beneath the barrel 86. In FIG. 3, the magazine 88 and action 92 are adjacent to one another, with the magazine being forward (i.e., approximately below the hand) relative to the action 92 (i.e., approximately below the elbow). In other embodiments, the magazine 88 is directly below the action 92. In still other embodiments, the action 92 is closer to the wrist than the elbow.

The magazine 88 contains the ammunition to be discharged by the firearm 100. The action 92, also known as a receiver, is the heart of any firearm. The action generally includes a sear, which holds the hammer in a cocked position. The sear will release the hammer when the trigger is actuated. In a typical implementation of a firearm, the hammer swings into a firing pin, which hits the primmer on a bullet. The bullet and gun powder are disposed inside a casing. When the firing pin hits the primmer, the primmer ignites the gun powder, which explodes the casing off the bullet, and the bullet shoots forward through the barrel toward its target. The action also includes a reloading device and bullet carrier such that, upon the bullet being fired (automatic firearm) or a new bullet being loaded into the bullet carrier (manual firearm), the firearm is able to fire again. In FIG. 3, the magazine 88 stores additional cases and bullets (cartridges) to be reloaded by a reloading device (not shown) in the action 92. The action or receiver may include an upper portion, or upper receiver, and a lower portion, or lower receiver. The lower receiver is the part of the action that has the serial number etched thereon, while the upper receiver features hardware for moving the bullet from the magazine into position for firing.

The novel firearm 100 may include any variety of additional features not described herein. Further description of the features is beyond the scope of this document. Indeed, legacy firearms, whether automatic or manual, handguns, pistols, shotguns, or rifles, may present these features differently than has been described. Handgun manufacturers and gun enthusiasts of ordinary skill in the art will recognize a variety of implementations of the novel firearm 100.

In a preferred embodiment, the magazine 88 and action 92 are disposed closer to the elbow of the user 90 than to the hand of the user. This is due to the fact that the action 92 and magazine 88 are somewhat heavy. By positioning them close to the elbow, their weight can be maintained not just by the forearm of the user 90, but by his upper arm and shoulder as well.

Figure 2:
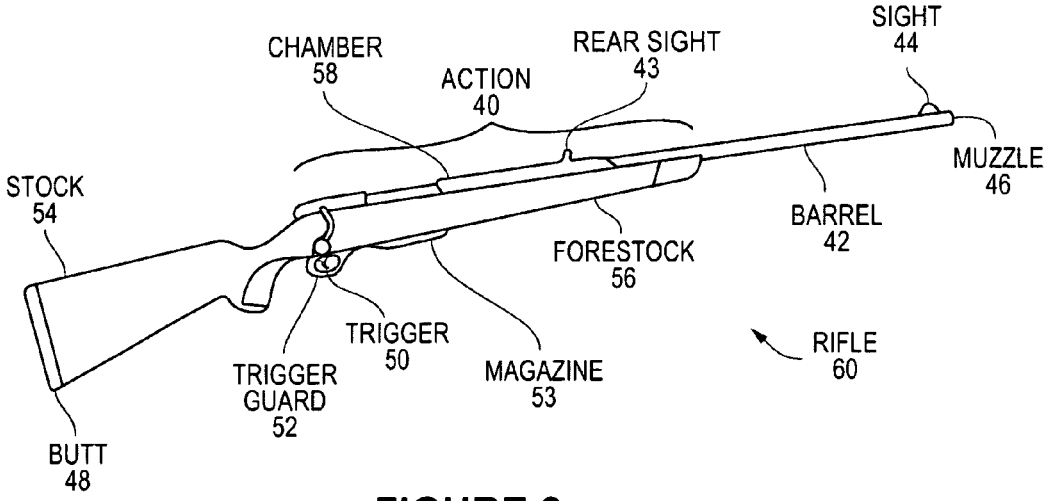
FIGURE 2 (Prior Art)
FIG. 2 is a diagram of a rifle, according to the prior art.

In contrast to legacy firearms, the novel firearm 100 does not include a traditional sight. The sight(s) is/are typically located atop the barrel of the firearm (e.g., FIGS. 1 and 2). Accordingly, the user lifts the firearm up so that the sight is viewable by his eye. In the case of a handgun or pistol, the forearm holding the firearm is typically extended forward of the body such that the user can see through the sight toward the target. A rifle is typically held with the butt against the shoulder of the user, again with the eye seeing the target through the sight. Therefore, a legacy firearm is most often held at chest level when firing.

In some embodiments, the novel firearm 100 includes an electronic sight 112, as depicted in FIG. 3. The electronic sight 112, such as a laser sight, produces a beam 118 visible to the user that extends forward for some distance, with the beam landing on the target. Thus, the user of the novel firearm 100 does not need to pull the firearm up toward his chest, as an eye-line sight is not necessary. In FIG. 3, the sight 112 is just below the barrel 86. In other embodiments, the sight is just above the barrel, in front of the hand grip (not shown). In still other embodiments, the sight is atop a specially configured hand grip, as described below in FIG. 5H.

The novel firearm 100 may be advantageous in certain situations, including, but not limited to, military and police/security operations. The firearm 100 is readily "worn" by the user, as described above, and may be maintained on the person of the user for quite a long period of time. Thus, the firearm 100 is useful for particular security situations in which the user may be positioned "at the ready" for extended periods of time. The firearm 100 is also beneficial where hand-to-hand combat takes place. Because the firearm 100 remains in place against the forearm of the user, the firearm may be used to block a body blow, for example. For those who are so trained, the firearm 100 may also be used on both arms.

In some embodiments, the firearm 100 includes a heat-dissipative material between the forearm stock 80 and the barrel 86. When discharged, firearms produce quite a bit of heat. The forearm stock 80 may itself be made of such heat-dissipative or heat-mitigating materials or include a distinct layer that promotes discharge of heat. The barrel 86 may also include vent holes (not shown) to promote heat dissipation.

FIGS. 5A-5H depict additional embodiments of the underarm stock 70. In FIG. 5A, an underarm stock 70A consists of the stock 80 and the forward vertical grip 72 only, with the trigger 82 and trigger guard 84 being part of the grip, as in FIG. 3, to be used with a firearm (not shown). The underarm stock 70A would be useful in environments in which the firearm 100A is to be grabbed quickly, for example.

In FIG. 5B, the underarm stock 70B consists of the grip 72 and the cradle 76, but no retaining strap 74. As with the underarm stock 70A, this device is most useful in situations where quick access to the firearm is beneficial. The firearm used with the underarm stocks 70A or 70B preferably includes a forestock, such as the forestock 110 (FIG. 3). The forestock 110 enables the user to grab the stock 70A/70B, quickly place the stock against the hisforearm, and hold the firearm in place with the other hand of the user grabbing under the forestock.

In FIG. 5C, the cradle 76 and retaining strap 74 of the underarm stock 70 (FIG. 3) are replaced with a hoop 94 in an underarm stock 70C. Here, the forearm slides through the hoop 94 and the hand grabs the grip 72 and trigger 82, for a secure fit of the stock 80 against the forearm. The hoop 94 may be made of a "memory" type of material, such as polychloroprene, that stretches to conform to the shape of the forearm, while maintaining a relatively snug fit against the arm once inserted therethrough.

FIG. 5D takes the hoop concept of FIG. 5C a bit further, with a full arm sleeve 96 being connected to an underarm stock 80. The grip 72 is disposed inside the sleeve 96 such that the forearm is entirely covered by the sleeve. Like the hoop 94 (FIG. 5C), the sleeve 96 may be made from a elastomeric material, such as is found in wetsuits, to ensure a snug fit of the stock 80 against the forearm of the user.

FIG. 5E features an upper arm cradle 98 attached to an underarm gun stock 70E, to be positioned against the upper arm of the user. The cradle 98 is coupled to a loop 122, through which the forearm is fed until the hand grabs the vertical grip 72. In some embodiments, the cradle 98 is a portion of a cylinder, disposed orthogonal to the forearm stock 80. The cradle 98 is preferably disposed against the top of the upper arm to provide additional bracing to steady the firearm for accuracy. In some embodiments, additional restraint around the arm between the wrist and the elbow is used to improve the bracing and essentially lock the wrist, so that the firearm becomes an extension of the lower arm. The upper arm cradle 98 may be connected to the cradle 76 (FIG. 3), the hoop 94 (FIG. 5C), the sleeve 96 (FIG. 5D), or to the loop 122 dedicated for this purpose. The upper arm cradle 98 is designed to provide additional support in maintaining the position of the firearm butt (not shown) against the shoulder of the user 90.

FIG. 5F shows an underarm stock 70F with a brace 102 extending upward from the forearm stock 80, with the brace 102 to connect to the shoulder of the user. The brace 102 is connected to a rod 101, where the rod is orthogonal to the forearm stock 80. Like the upper arm cradle 98 (FIG. 5E), the brace 102 is designed to additionally support the firearm (not shown), but against the shoulder of the user. The underarm stock 70F may be preferred by those who are comfortable shooting rifles, as the brace 102 causes pressure to be applied against the user's shoulder.

FIG. 5G depicts an underarm stock 70G with a retaining strap 74 and cradle 76, coupled with the upper arm cradle 98 and shoulder brace 102. These features may be presented in a variety of other combinations, all designed to secure the firearm 100 against the forearm of the user 90.

FIG. 5H depicts an underarm stock 70H with a specialized hand grip 124, according to some embodiments. The hand grip 124 is adapted so that a sight 112B can be mounted thereto. The surface of the hand grip is as suitable for receiving the sight as positioning the sight beneath the barrel (FIG. 3) or above the barrel (not shown) achieves.

The embodiments of FIGS. 5A-5H may be further enhanced, such as for specialized use of the firearm 100. In some embodiments, a second hand grip is mounted on the stock 80 for additional support and/or bracing. Such additional bracing would be preferred to facilitate reloading of the firearm, especially if the firearm is not automatic or semi-automatic. Electronic sights may be mounted above the hand grip (FIG. 5H), below the barrel (FIG. 3), above the barrel (not shown), along the side of the barrel (not shown), or in another position on the firearm 100, which can support the sight. The action and barrel(s) may be mounted above the hand grip (as with legacy firearms), or may be mounted below the hand grip, as in FIG. 3. In a preferred embodiment, the action and barrel(s) are mounted below the stock 80, with the bulk of the weight of the action being nearer the elbow, especially for larger, more powerful, and obviously heavier guns.

Figure 6A:
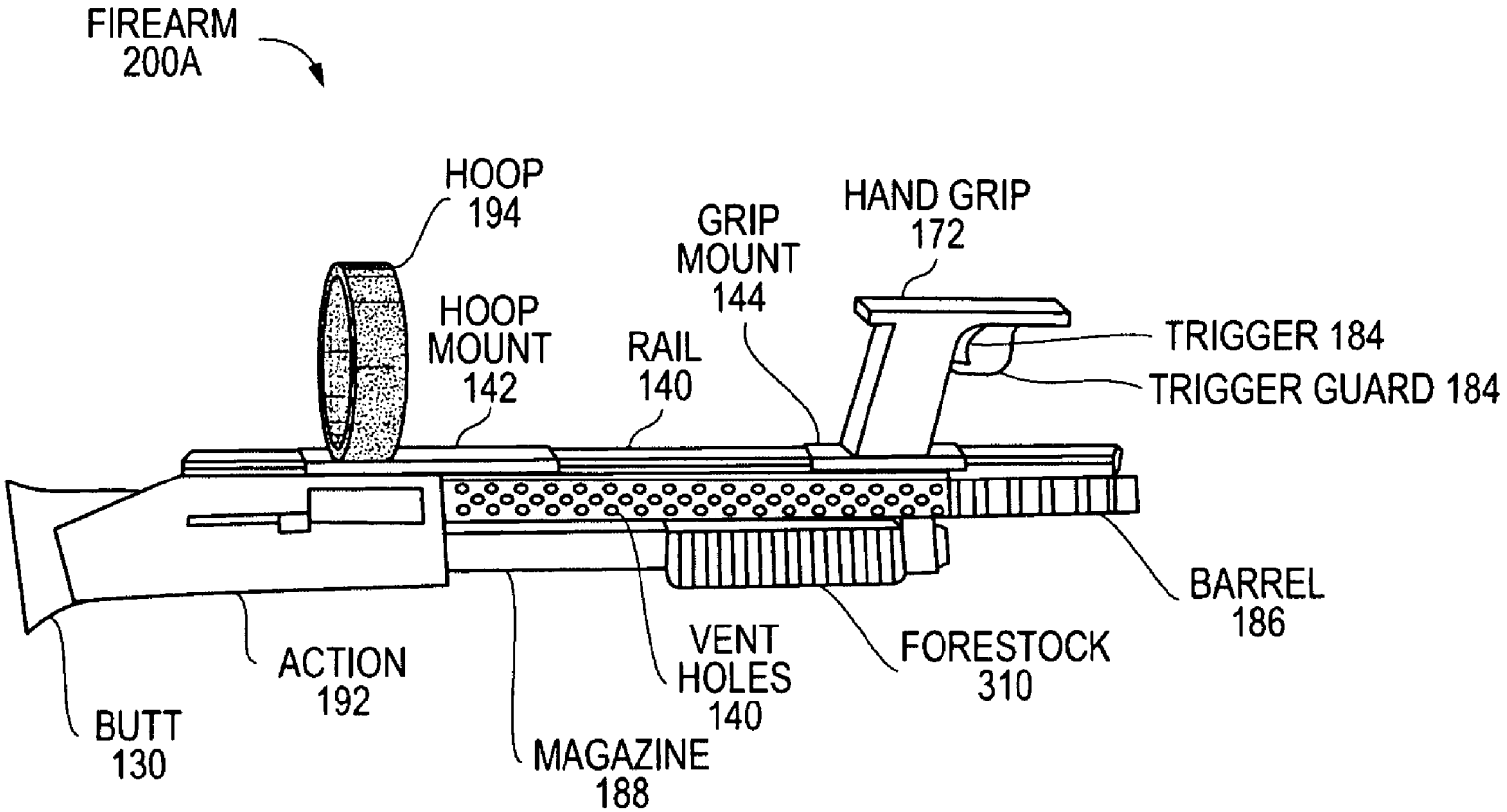
FIGS. 6A and 6B are two depictions of a novel firearm having no underarm gun stock, according to some embodiments.

FIG. 6A is a firearm 200 having no underarm gun stock, according to some embodiments. The firearm 200 includes a barrel 186, a magazine 188, and an action 192, with the action disposed near the back of the firearm.

Like the firearm 100 (FIG. 3), the firearm 200 is designed to be worn on the forearm of the user 90. In this embodiment, the firearm 200 includes a rail or rails 140 disposed above the barrel 186. The rail 140 enables a hoop 194 and a hand grip 172 to be fixably attached to the firearm. Alternatively, the rail may enable other means to connect the firearm 200 against the forearm of the user 90. The hoop 194 is disposed upon a hoop mount 142, which slides along the rail. Likewise, the hand grip 172 is disposed upon a grip mount 144, which also slides on the rail 140. The hoop mount 142 and grip mount 144 may include hardware for fixing the mount in place along the rail once a desired position for each is obtained.

Like the firearm 100 (FIG. 3), the firearm 200 is designed for the user to wear on his forearm. The barrel 186 includes vent holes 140 to dissipate heat away from the barrel 186 upon firing the weapon. In some embodiments, the rail 140 is made of a heat-dissipating material that does not get hot on its top surface (near the forearm), but instead gets hot on its bottom surface (near the barrel).

Figure 6B:
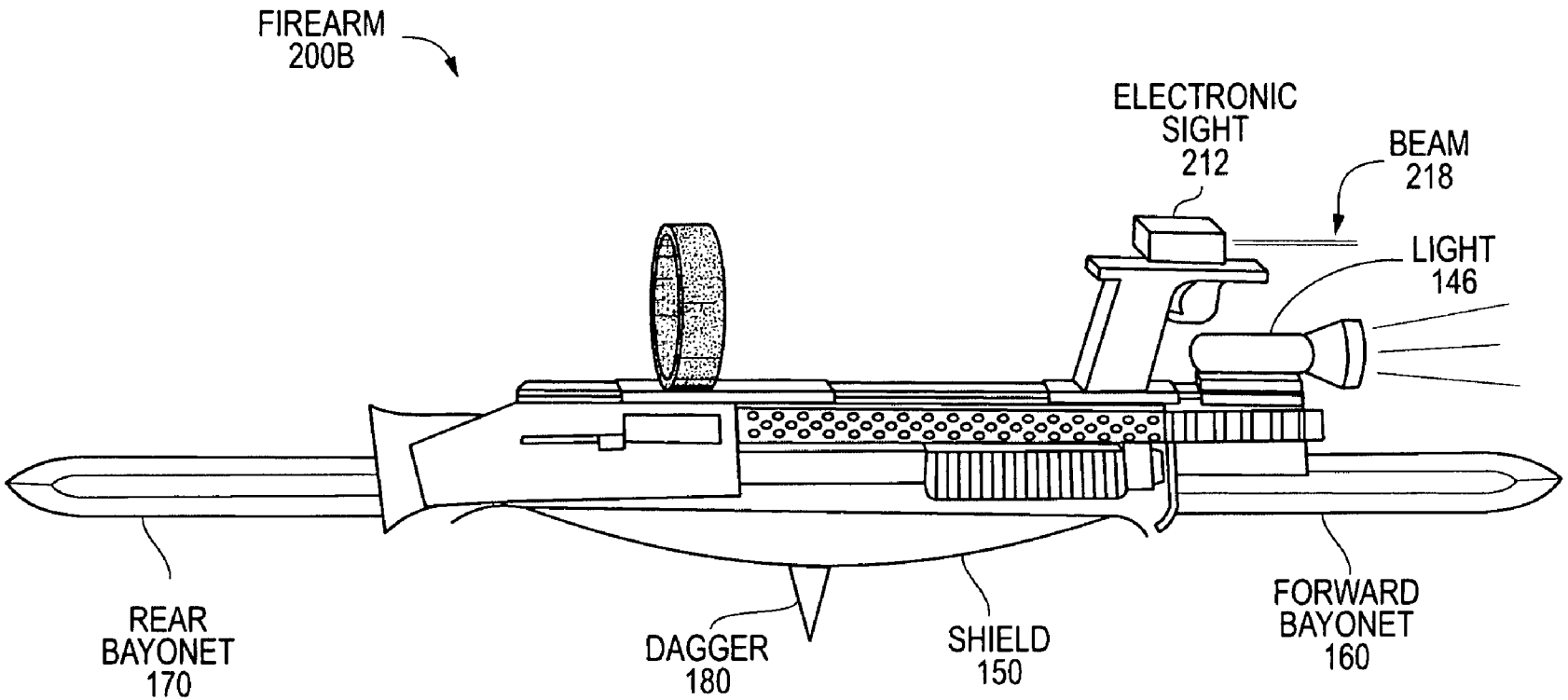

FIG. 6B is an enhanced firearm 200B, according to some embodiments. An electronic sight 212 is mounted atop the hand grip 172, to produce a beam of light 218 that hits the intended target, for more accurate use of the firearm. A light 146 is also mounted on the firearm 200B. The firearm 200B includes a forward bayonet 160, for forward thrust against a target, a rear bayonet 170, for rear thrust against a target, and a vertically disposed dagger 180 pointing toward the ground. The dagger 180 may be thrust against a target when the user 90 holds his forearm up, such as in a defensive gesture.

The firearm 200B also includes a shield 150, disposed below the magazine 188. In some embodiments, the shield is a half-circle shape, with the flat part of the half-circle being roughly below the medial part of the forearm of the user, with the rounded part of the shield extending horizontally outward from the user. The shield 150 is used in defense, such as during hand-to-hand combat.

Figure 7:
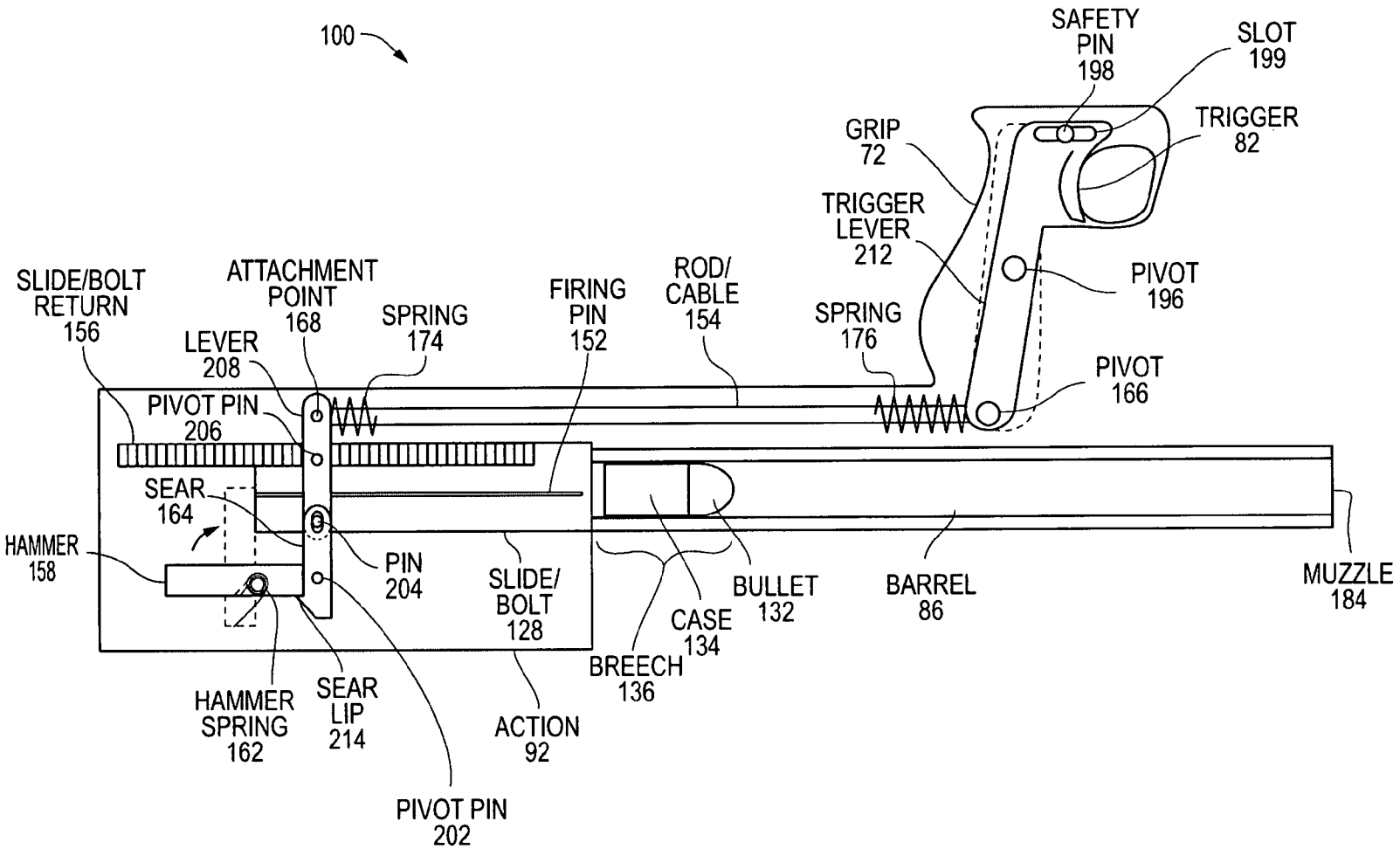
FIG. 7 is a cutaway view of the novel firearm of FIG. 3, showing details of the action, according to some embodiments.

FIG. 7 is a cutaway view of the novel firearm 100 of FIG. 3, which depicts the connection between the trigger 82 and the action 92, according to some embodiments. The trigger 82 includes a safety pin 198 that fits in a slot 199 that is part of a trigger lever 212. The safety pin 198 prevents the trigger lever 212 from moving when engaged. When the safety 198 is released, the trigger lever 212 is able to move along a pivot 196, and does so when the trigger is activated. The movement of the trigger lever 212 about the pivot 196 causes a rod/cable 154 be pulled at attach point 166. The rod/cable 154 is coupled between two attach points 166, 168, the latter of which is connected to a lever 208.

The trigger lever 212 and lever 208 are approximately orthogonal to the rod/cable 154. In FIG. 7, the rod/cable 154 is disposed horizontally, and so the lever 208 and the trigger lever 212 are approximately vertical, with the positions being relative to one another. The firearm 100 may have other configurations, such as where the rod/cable 154 is vertical. System designers of ordinary skill in the art will recognize a number of different configurations that may be implemented in the novel firearm 100.

The lever 208 is connected to a sear 164 by a pin 204. A pivot pin 206 enables the lever to swing about the pivot. The sear 164 likewise has a pivot pin 202, which also enables the sear to swing about the pivot 202. The sear 164 includes a lip 214 that is disposed under a hammer 158, holding the hammer 158 in a predetermined position (in FIG. 7, the predetermined position is horizontal). In FIG. 7, the sear 164 is in a stable position, with the sear lip 214 holding the hammer 158 in place. When the trigger 82 is activated, the cable/rod 154 is pulled toward the grip 72, as described above, causing the lever 208 to move with the rod toward the grip. This causes the sear 164 to move away from the hammer 158, such that the sear lip 214 releases the hammer 158 from its stable position.

The hammer 158 is held in place by a hammer spring 162. A slide/bolt 128, disposed above the hammer 158, contains a firing pin 152. A bullet 132 in a case 134 is disposed inside a breech 136 at the back of the barrel 86. Once released, the hammer 158 rotates (in this case, clockwise), hitting the firing pin 152, which then strikes the primer (not shown) in the case 134 of the bullet 132, causing ignition of the gun powder (not shown) inside the case. This explosion causes the bullet 132 to propel forward through the barrel 86 and out the muzzle 184 toward the target. The lever 208 may be in front of or behind the slide/bolt 138.

In this embodiment, the recoil from the explosion of the gunpowder causes the slide/bolt 138 to slide backwards (left), which re-cocks the hammer 158. The slide/bolt return spring 156 returns the slide/bolt 138 to the closed position and loads a fresh case 134 and bullet 132 from the magazine (not shown). Thus, the entire assembly is ready for subsequent firing.

Figure 8:
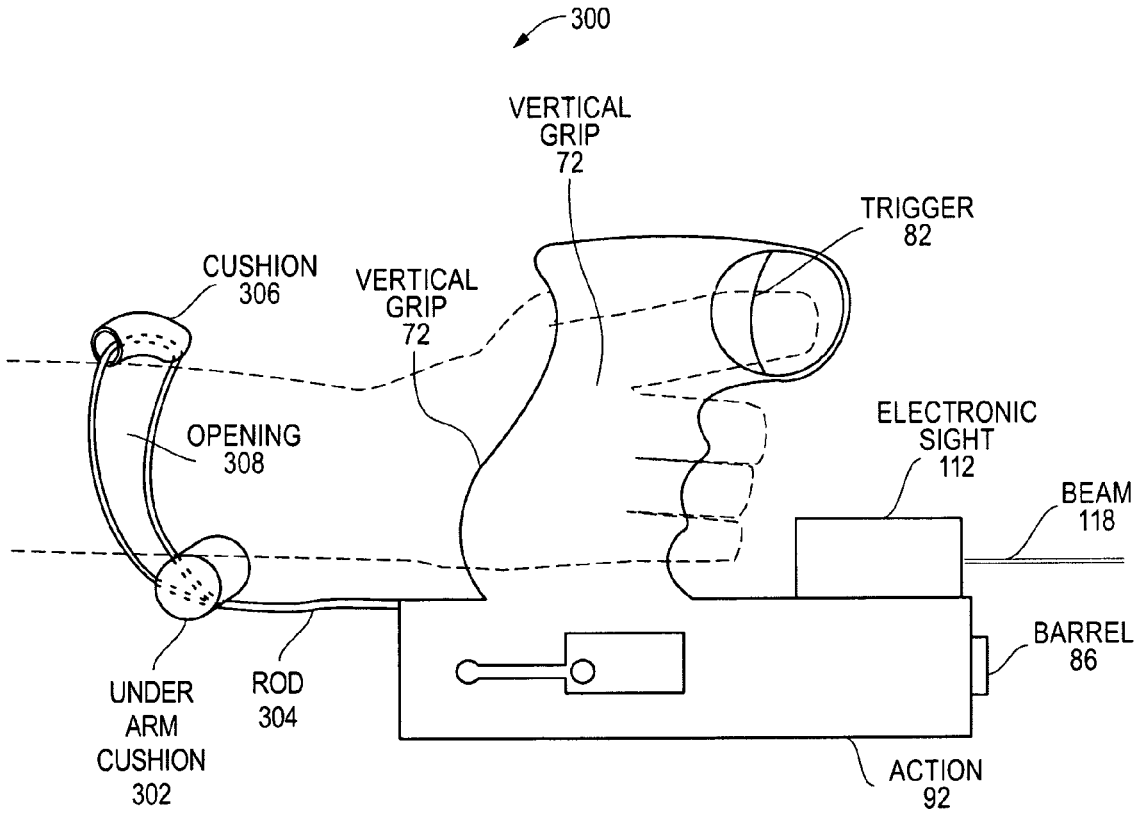
FIG. 8 is a drawing of another novel firearm, according to some embodiments.

FIG. 8 is a drawing of yet another novel firearm 300, according to some embodiments. In this embodiment, the firearm 300 is worn by the user 90, not on his entire forearm, but merely on his wrist. As before, the firearm 300 includes a vertical grip 72 with an embedded trigger 82, with which the user 90 holds the firearm. Again, the action 92 and barrel 86 are disposed beneath the grip 72, although this firearm includes no stock. A rod 304 extends from the rear of the action 92. In some embodiments, the rod 304 is a loop, with both ends of the loop connecting to the rear of the action 92, the two ends of the loop being held together as if a single rod, until reaching an underarm cushion support 302, then flaring outward, with a cushion 306 covering the rod 304 at its distal end, as depicted in FIG. 8. In some embodiments, the underarm cushion 302 is cylindrical in shape and is disposed just above the wrist but below the arm, while the cushion 306 is disposed just above the wrist and above the arm. The user 90 thus places his hand through the opening 308 of the rod 304 between the cushion 306 and the underarm cushion 302, and grabs the vertical grip 72, with his index finger positioned over the trigger 82. The rod 304 is sufficiently sized to ensure that the firearm 300 remains snugly worn on the arm of the user 90, and essentially locks the wrist so that the novel firearm 300 is an extension of the lower arm.

The novel firearm 300 may include an electronic sight 112 that produces a beam 118, such as a laser, of light toward the target. The action 92 and barrel 86 of the firearm 300 are below the hand of the user 90, while the trigger 82 remains incorporated as part of the grip 72.

Figure 9:
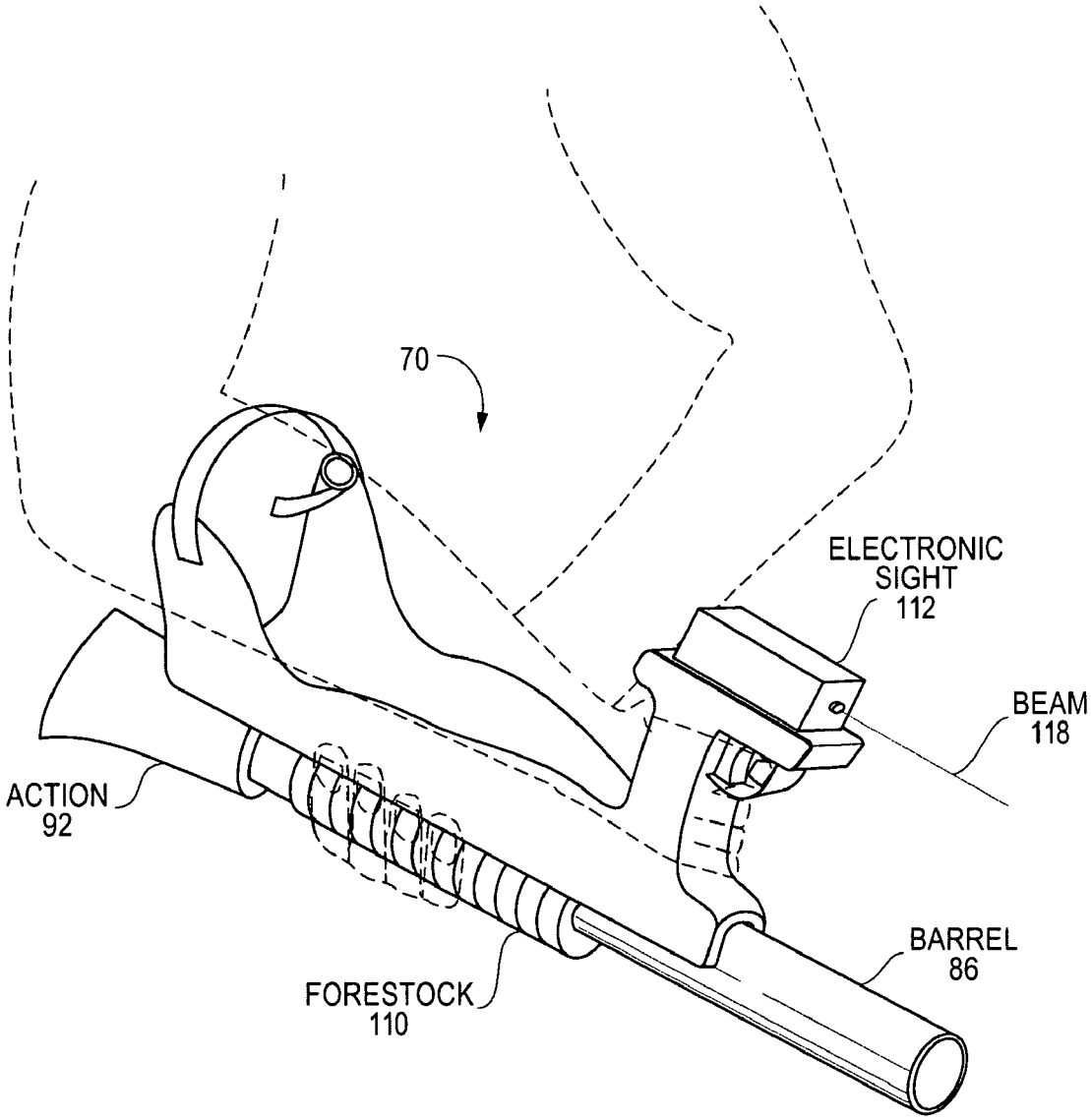
FIG. 9 is a perspective drawing of the underarm stock of FIG. 3, in which the firearm includes a forestock to be gripped by the user, according to some embodiments.

FIG. 9 is a perspective drawing of the underarm gun stock 70. In this embodiment, the firearm includes a forestock 110. Although the stock 70 includes the retaining strap 74 that holds the stock flush against the forearm of the user, the forestock 110 enables the user to grasp the firearm with the other arm (in this case, the left arm), for more secure positioning of the firearm. The forestock 110 may likewise be useful for the gun stock 70A (FIG. 5A) or 70B (FIG. 5B) in which there is no retention device.

Several benefits may be realized with the firearm 100 (with underarm gun stock) and the firearm 200 (without underarm gun stock). The firearms 100 and 200 promote a steady shot with a single hand. If used in conjunction with modern electronic sights, the firearms 100 and 200 promote an accurate shot from a more comfortable position/posture than with a traditional firearm. The firearms 100 and 200 may be used around corners, above foxholes, or over the head of the user. The firearms 100 and 200 potentially permit heavier firepower to be used in a more compact gun. And, as illustrated in FIG. 6B, the bottom of the firearm 200 may be used as a defensive shield in hand-to-hand combat, or a defensive shield can be attached to additional weaponry. The firearms 100 and 200 may be enhanced with additional weaponry, including, but not limited to, the aforementioned shield, blades, bayonets (fore and/or aft), or a ramming butt.

The weapons 200B (with additional weaponry properly mounted) in each hand of a qualified person may be more lethal to adversaries than traditional weapons, especially in hand-to-hand combat and close quarters fighting.

While the application has been described with respect to a limited number of embodiments, those skilled in the art will appreciate numerous modifications and variations therefrom. It is intended that the appended claims cover all such modifications and variations as fall within the true spirit and scope of the invention.

I claim:

1. A novel firearm, comprising:

an underarm stock, comprising:

a forearm stock having a top surface and a bottom surface, the top surface to be disposed against and beneath a forearm of a user; and a grip comprising a trigger, the grip to be held by a hand of the user such that the trigger is accessible to a finger of the user;

a barrel disposed against the bottom surface and beneath the forearm stock, wherein a bullet travels through the barrel when the firearm is discharged; and an action disposed beneath the forearm stock, the action comprising a firing pin and a hammer;

wherein the action is mechanically coupled to the trigger such that, when the trigger is actuated by the finger, the hammer hits the firing pin such that the bullet is fired toward the target.

2. The novel firearm of claim 1, the underarm stock further comprising:

a cradle to fit near an elbow of the user, the cradle comprising a lateral portion and a medial portion, wherein the lateral portion is disposed against the outside of the forearm and the medial portion is disposed against the inside of the forearm.

3. The novel firearm of claim 2, the underarm stock further comprising:

a retaining strap permanently connected at one end to the lateral portion of the cradle, wherein the retaining strap is affixed to the medial end of the cradle and adjusted so that the forearm stock is flush against the underside of the forearm.

4. The novel firearm of claim 1, the underarm stock further comprising:

a hoop through which the user feeds his hand until grasping the grip, the hoop to secure the forearm stock against the underside of the forearm.

5. The novel firearm of claim 1, the underarm stock further comprising:

a sleeve through which the user feeds his hand until grasping the grip, the sleeve to secure the forearm stock against the underside of the forearm.

6. The novel firearm of claim 1, the underarm stock further comprising:

a loop fixably attached to the forearm stock, the loop being large enough for the hand of the user to thread therethrough; and an upper cradle coupled to the loop, the upper cradle being a portion of a cylindrical, the portion being orthogonal to the forearm stock;

wherein the upper cradle rests against an upper arm of the user.

7. The novel firearm of claim 1, the underarm stock further comprising:

a brace fixably attached to the forearm stock by a rod, the rod being orthogonal to the forearm stock;

wherein the brace rests against the shoulder of the user.

8. The novel firearm of claim 1, further comprising:

an electronic sight transmitting a laser beam toward a target;

wherein the electronic sight is disposed close to the barrel of the firearm.

9. The firearm of claim 1, further comprising:

a trigger lever to move about a pivot when the trigger is activated;

a rod coupled between the trigger lever and a second lever, wherein the second lever is coupled to a sear;

wherein the sear releases a hammer, which strikes a firing pin, and the firing pin strikes the ammunition when the trigger is activated.

10. The firearm of claim 1, further comprising:

a forestock disposed beneath the barrel;

wherein the grip is held by the hand of the user and the forestock is held by a second hand of the user during use of the firearm.

11. A firearm, comprising:

a rail disposed atop a barrel, wherein ammunition travels through the barrel upon activating the firearm;

a hand grip disposed upon the rail, the hand grip comprising a trigger and a trigger guard, the hand grip to be grasped by a user such that a finger of the user is disposed through the trigger guard against the trigger;

means for affixing the rail beneath a forearm of the user so that the rail is positioned between the elbow and the hand of the user; and an action disposed beneath the rail, wherein the action is mechanically coupled to the trigger such that, when the trigger is actuated by the finger, the bullet is fired toward a target.

12. The firearm of claim 11, wherein the means for affixing the rail beneath a forearm of the user comprises a hoop, wherein the user feeds his forearm through the hoop before grasping the hand grip.

13. The firearm of claim 12, further comprising:

a grip mount to slide along the rail, wherein the hand grip is disposed upon the grip mount; and a hoop mount to slide along the rail, wherein the hoop is disposed upon the hoop mount;

wherein the grip mount and hoop mount are positioned along the rail, then secured against the rail so that the hand grip and hoop do not slide during use of the firearm.

14. The firearm of claim 11, wherein the barrel includes vent holes to dissipate heat from the barrel during discharge of the firearm.

15. The firearm of claim 11, further comprising:

a forward bayonet disposed adjacent to the barrel, wherein the forward bayonet points forward of the user when the rail is affixed beneath the forearm.

16. The firearm of claim 15, further comprising:

a rearward bayonet disposed adjacent to the action, wherein the rearward bayonet points backward of the user when the rail is affixed beneath the forearm.

17. The firearm of claim 11, further comprising:

a shield disposed adjacent to and beneath the action, the shield extending away from the user, wherein the shield is parallel to the ground.

18. The firearm of claim 11, further comprising:

a dagger disposed orthogonal to the barrel of the firearm.

19. A firearm, comprising:

a vertical grip comprising a trigger guard, wherein a trigger is disposed in the trigger guard;

an action disposed beneath the vertical grip, the action comprising means for firing ammunition through a barrel;

a loop rod extending in back of the vertical grip, the loop rod connecting to an underarm cushion and having a hoop disposed therethrough, wherein a user feeds his hand through an opening of the loop rod and grabs the vertical grip such that the hoop is positioned above the wrist of the user and the underarm cushion is beneath the lower arm of the user, holding the firearm in place against the arm of the user.

20. The firearm of claim 19, further comprising:

an electronic sight disposed above the barrel, wherein the sight sends a laser beam toward a target.

* * * * *